United States Patent [19]

Owen et al.

[11] Patent Number: 4,594,743

[45] Date of Patent: Jun. 17, 1986

[54] AIR SUPPORT BED

[75] Inventors: Charles C. Owen, Chicago; Charles B. Owen, Long Grove, both of Ill.; Hsi-Tao (Steve) Lin, Taipei, Taiwan

[73] Assignee: Siesta Corp., Northbrook, Ill.

[21] Appl. No.: 629,350

[22] Filed: Jul. 10, 1984

[51] Int. Cl.[4] ..... A47C 19/12; A47C 17/64; A47C 27/08

[52] U.S. Cl. ..... 5/111; 5/112; 5/449; 5/454; 5/457

[58] Field of Search ..... 5/449, 455, 451, 450, 5/82 R, 111, 112, 114, 453, 457, 454

[56] References Cited

U.S. PATENT DOCUMENTS

| | | | |
|---|---|---|---|
| 979,227 | 12/1910 | Tinkman . | |
| 1,100,380 | 6/1914 | Kreuzkamp . | |
| 1,142,876 | 6/1915 | Davis et al. | 5/284 |
| 1,183,367 | 5/1916 | Freedman et al. . | |
| 1,228,783 | 6/1917 | Kerivan . | |
| 1,367,173 | 2/1921 | Berta . | |
| 1,389,682 | 9/1921 | Melniker . | |
| 1,594,988 | 8/1926 | Allman . | |
| 1,625,476 | 4/1927 | Larsen . | |
| 3,045,257 | 7/1962 | Knapp | 5/111 |
| 3,336,060 | 8/1967 | Bradford . | |
| 3,426,367 | 2/1969 | Bradford . | |
| 3,538,521 | 11/1970 | Basner | 5/462 |
| 3,620,428 | 11/1971 | Silverthorne | 5/114 |
| 3,689,945 | 9/1972 | Laerdal | 5/453 |
| 3,742,529 | 7/1973 | Stehlik | 5/114 |
| 3,761,975 | 10/1973 | Personett . | |
| 3,780,388 | 12/1973 | Thomas et al. . | |
| 3,797,051 | 3/1974 | Evans | 5/111 |
| 3,967,330 | 7/1976 | Zawadowsky | 5/114 |
| 4,371,615 | 6/1984 | Whitney . | |
| 4,371,999 | 2/1983 | Reid . | |
| 4,517,693 | 5/1985 | Viesturs | 5/451 |

FOREIGN PATENT DOCUMENTS

| | | | |
|---|---|---|---|
| 1108338 | 1/1956 | France | 5/111 |
| 1418202 | 10/1965 | France | 5/112 |

*Primary Examiner*—Alexander Grosz

*Attorney, Agent, or Firm*—Dressler, Goldsmith, Shore, Sutker & Milnamow, Ltd.

[57] ABSTRACT

A portable and collapsible bed includes a generally rectangular tubular frame and an inflatable mattress with the inflatable mattress having a connecting means that has loose flaps extending towards the periphery of the hollow main flexible body with the flaps having connectors on the ends thereof which can be connected to the tubes of the tubular frame. The tubular frame is formed in a plurality of sections that are easily separable and can be collapsed to a small fraction of the overall size of the unit while the air mattress, in a deflated condition, remains supported on the frame. The unit also includes an inflating unit that can be converted to a deflating unit without any extraneous tools.

19 Claims, 9 Drawing Figures

10
12
20
22
50
82
84
88
90
100
102
104
105
106
108
109
110
130
132
134
136
140
142
16

AIR SUPPORT BED

TECHNICAL FIELD

The present invention relates generally to inflatable mattresses and, more particularly, to a portable and collapsible bed that stores in a very compact manner and is easily inflated for use as a support bed.

BACKGROUND PRIOR ART

Portable sleeping accommodations have been in existence for a number of decades and the most common type of unit that has been used extensively is what is commonly referred to as a rollaway bed. The rollaway bed consists of a generally tubular frame structure that has a center base which is a generally U-shaped subframe which has rollers on the four corners thereof and the remainder of the frame is pivoted on the base to be movable from a generally vertical position to a horizontal useable position. In the horizontal useable position, pivoted end legs on the outer ends of the frame support the unit during use.

This type of bed generally has a mattress that is releaseably supported on the frame and is stored within the frame during periods of non-use. In the stored condition, the rollaway beds of this type are approximately 4′ in height and a single bed is generally approximately 3′ in width and approximately 1′ in depth. Such a unit, with an adequate mattress, generally is too heavy to be physically transported about by one person and, thus, has the rollers or casters so that the bed can be moved about in the collapsed condition.

Numerous other portable-type bedding has been utilized in emergency situations, and examples of such devices are inflatable units that can also double as rafts for aquatic activities. For example, a conventional raft is approximately 3′×6′ in dimension and is either manually or power-inflatable from a collapsed, small stored condition to a fully-inflated position that is capable of supporting adults on water. While such units have been utilized as support beds for emergency conditions, the comfort of such units leaves much to be desired, particularly since such a unit is generally inflated and placed on a hard floor.

While there are literally dozens of different types of collapsible and expansible units that can be utilized as beds, there is a constant need for a unit of this type which can be manufactured at a minimum cost, stored in a very compact condition, and still provide the desired comfort during use.

SUMMARY OF THE INVENTION

According to the present invention, a portable and collapsible bed has been developed which can be mass produced at a minimum cost, packaged for shipment in a very compact space, and stored in a compact condition, such as along the backwall of a closet, and still be transportable about and set-up by one person without the use of any special tools.

The portable and collapsible bed of the present invention consists of an elongated, generally rectangular tubular frame and inflatable mattress with the inflatable mattress including a hollow flexible body that has a peripheral configuration conforming generally to the tubular frame and a separate attaching member having a permanent connection joined to the main body on one side thereof inwardly of the periphery to produce loose flaps which extend outwardly and are connectable to portions of the tubular frame.

The tubular frame consists of a rigid intermediate portion that has a generally U-shaped center support leg which has brackets on the upper ends thereof with first and second tubes pivoted on each of the brackets and extendible in opposite directions from the intermediate member. A pair of generally U-shaped rigid tubular end members define the opposite ends and are connected to the opposite ends of the respective tubes and each have a support leg pivoted between collapsed and supporting positions. The end members are preferably releaseably connected to the ends of the tubes so as to be completely separable therefrom so that the unit can easily be collapsed to approximately ¼ of the overall length of the bed and be very compact in depth while still being very easily assembled and set-up for use as a bed.

According to one aspect of the invention, the collapsible and portable bed also has an inflator unit forming a part thereof which is attached to the frame and has an outlet or end cap connectable to an inlet valve to the air mattress and is power-operated so that the air mattress can quickly and easily be inflated in a short period of time. The inflator also can act as a deflating device by merely removing one component and reversing the position thereof.

BRIEF DESCRIPTION OF SEVERAL VIEWS OF DRAWINGS

DETAILED DESCRIPTION

Figure 1:
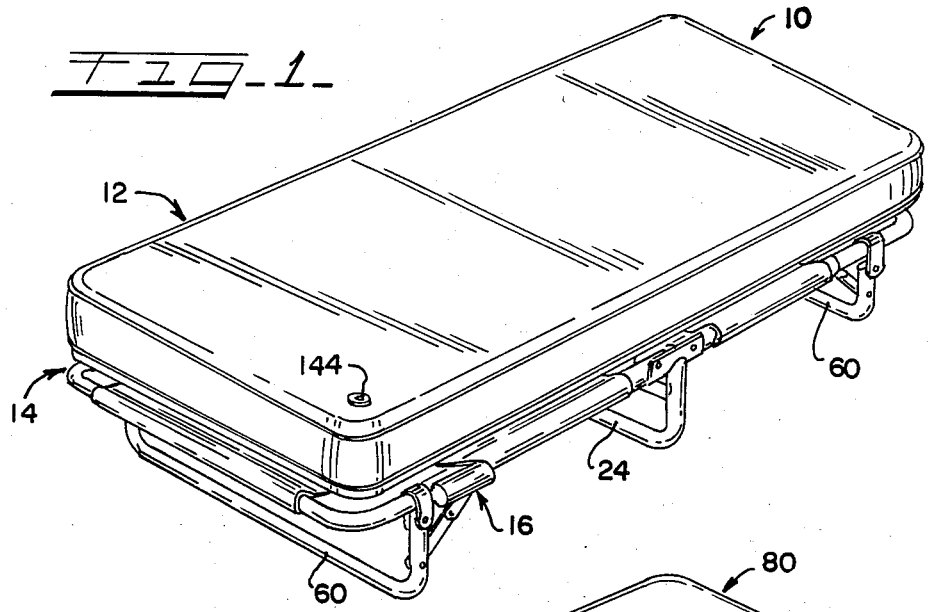
FIG. 1 is a perspective view of the collapsible and foldable bed constructed in accordance with the teachings of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 of the drawings shows a portable and collapsible bed, generally designated by reference numeral 10, constructed in accordance with the teachings of the present invention and including an inflatable mattress 12, a collapsible frame 14 and an inflator 16.

Figures 3, 4:
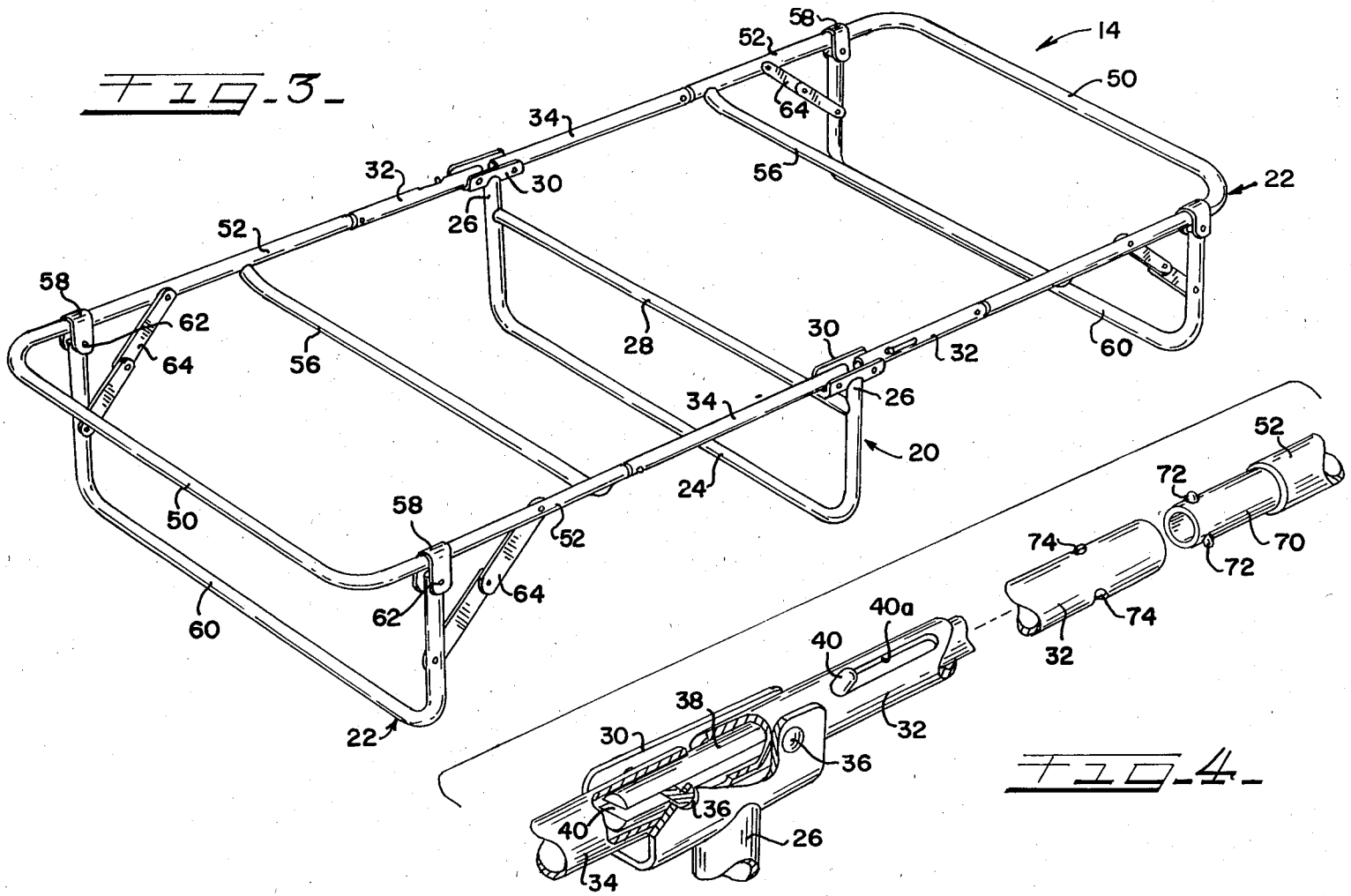
FIG. 3 is a perspective view of the collapsible tubular frame shown in the fully-extended position with the inflatable mattress removed for purposes of clarity.
FIG. 4 is a fragmentary sectional view of a portion of the frame showing the various interconnected components of the frame.

The frame structure 14 is most clearly illustrated in FIG. 3 and includes an intermediate portion 20 and a pair of substantially identical end members 22 which are all formed from a plurality of tubes and other interconnecting members of lightweight metal, such as aluminum or steel.

The intermediate portion or member 20 consists of a generally U-shaped center tubular support leg 24 that has upper free ends 26 that are interconnected by a tubular cross-brace 28. A pair of identical brackets 30 are rigidly secured to the upper free ends 26 of support leg 24 and each bracket supports first and second tubes 32 and 34. As shown in FIG. 3, the tubes 34 are longer than the tubes 32, for a purpose that will be described later.

The brackets 30 and tubes 32 and 34 also have interlocking means to locking the tubes in the extended position illustrated in FIG. 3, and the details thereof are shown in FIG. 4. As shown in FIG. 4, the inner end of tubes 32 and 34 are pivoted to brackets 30 on pins 36. A slide lock 38 has an elongated slot **4*a* which receives the respective pins 36 and the slide lock 38 is slideable inside of the tubes and has a latch or lever 40 extending therefrom. Thus, with the slide lock 38 in the position illustrated in FIG. 4, the tubes 32 and 34 are locked in the extended position illustrated in FIG. 3 with respect to the bracket 30. If it is desired to pivot the tubes to the retracted position for storage, the lever 40 is gripped and slid along the slot 40*a* in tube 32 until the slide lock 38 is completely retracted within tube 32 whereupon both tubes 32 and 34 can be pivoted from the generally-horizontal position illustrated in FIGS. 3 and 4 to a vertical position, illustrated in FIG. 7**, as will be explained later.

The tubular frame 14 also includes two identical end members 22, as explained above. Each end member consists of a single, generally U-shaped tube 50 that has a pair of legs 52 extending from a bite portion 54 with the legs 52 being unequal in length, and the difference in length being equal to the difference in length between the respective tubes 32 and 34. The respective legs 52 are interconnected by a cross-brace 56 to define a rigid, generally U-shaped end member which has a pair of brackets 58 affixed thereto. A support leg 60 in the form of a U-shaped tube is pivoted by pins 62 on the respective brackets 58 and is movable between collapsed and supporting positions with the supporting position being shown in FIG. 3. Preferably, the legs 60 are latched in the supporting position through a toggle linkage 64 connected to a leg 52 and to leg 60.

The end members 22 are preferably again releasably connected to the tubes 32 and 34 through a readily releasable connection that allows complete separation of the end members from the intermediate member 20. Thus, as illustrated in FIG. 4, the ends of legs 52 have reduced telescoping portions 70 extending from the free end of the tubes, with spring-biased latch pins 72 carried by the telescoping members 70. The ends of tubes 32 and 34 have openings 74 that are axially-spaced from the ends of the tube by a dimension equal to the spacing between the ends of the legs 52 and latch element 72.

Figure 2:
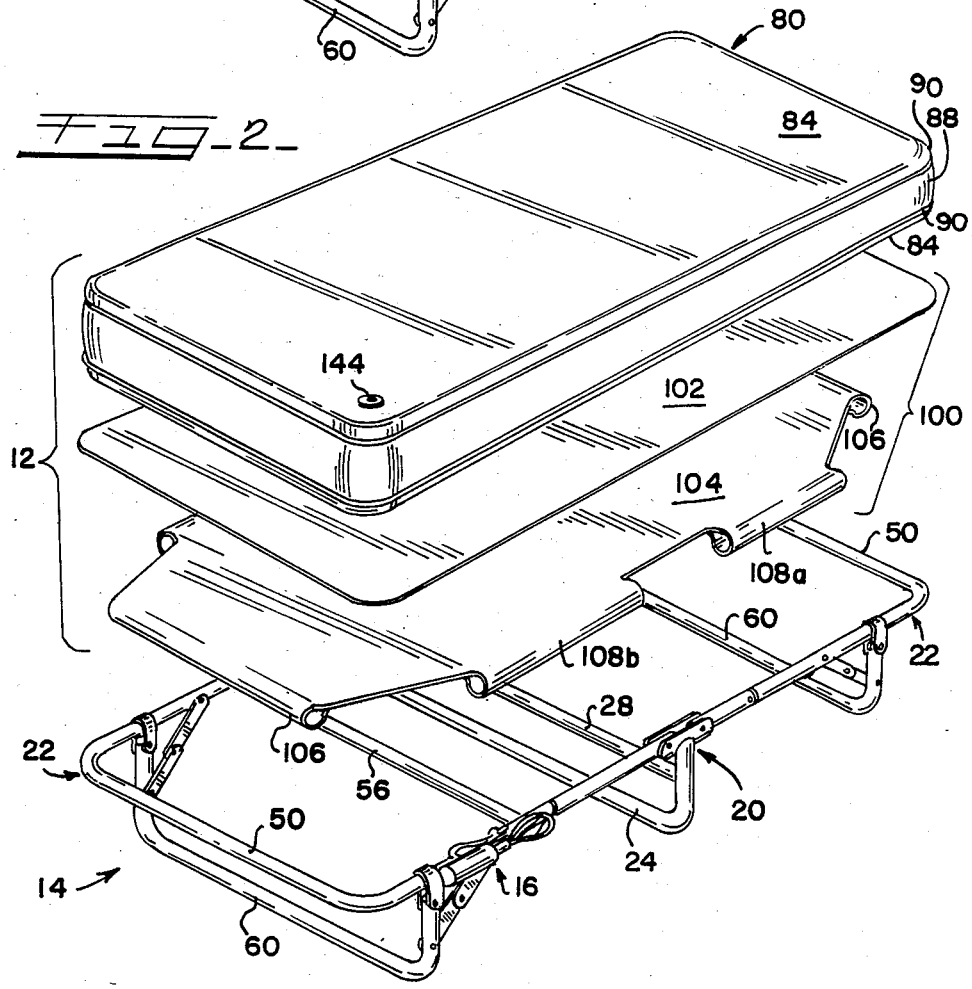
FIG. 2 is an exploded view of the various components that form the bed shown in FIG. 1.
Figures 5, 6, 7, 8, 9:
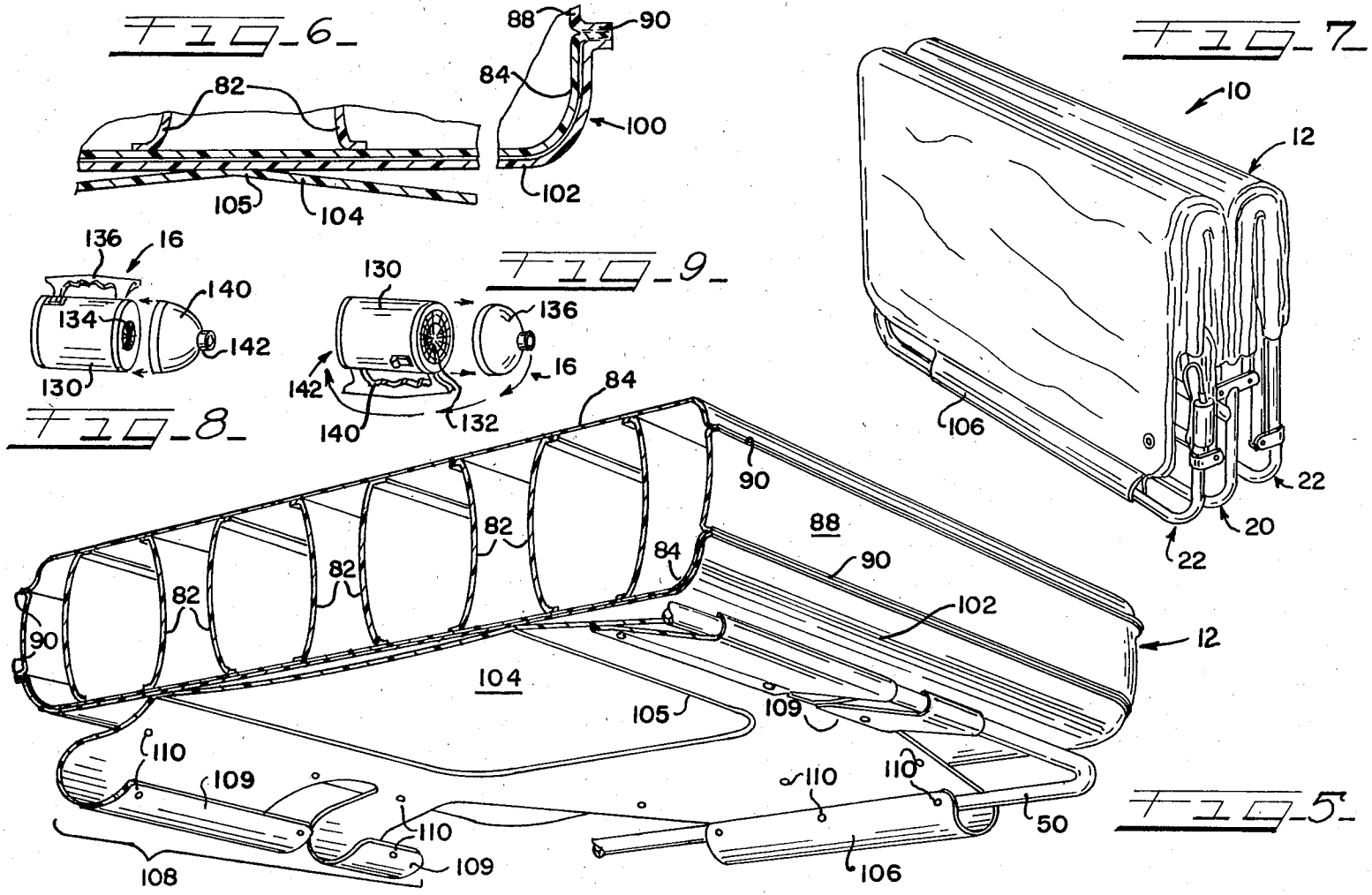
FIG. 5 is a fragmentary cross-sectional view showing the inflatable mattress and portions of the frame with the connection means therebetween.
FIG. 6 is an enlarged fragmentary (cross-)sectional view of the inflatable mattress.
FIG. 7 is a perspective view showing the bed in a fully collapsed position for storage.
FIG. 8 is a perspective view of the inflator formin of the bed unit.
FIG. 9 is a view similar to FIG. 8 showing the inflator components in a second position.

Before describing the collapsed and extended positions for the frame structure 14, the detail description of the inflatable mattress 12 appears to be in order. As shown in FIGS. 2, 5 and 6, the inflatable mattress consists of a main hollow flexible body 80 that is subdivided into a plurality of individual cells through baffles 82, as shown in FIG. 5. A main body 80 is formed from upper and lower, generally flat heat-sealable pieces of material 84, that are interconnected around the perimeter thereof through a connecting piece 88. The connection is preferably overlapping heat-sealed connection or joints 90 that extend around the entire periphery of the hollow body 80.

An attaching member 100 (FIG. 6) is preferably connected to the hollow main body 80 and consists of a heat-sealable plastic layer of material 102 that has its periphery heat-sealed to one of the joints 90, as shown in FIG. 6, while the remainder of the layer of material 102 remains detached from the hollow main body 80. A connecting member 104 is connected to the flat member 102 through a heat-sealing joint 105 which is located inwardly of the peripheral confines of the hollow body 80 and is spaced inwardly from opposite ends, as well as opposite sides, of the generally hollow rectangular body 80, illustrated in FIG. 2.

Thus, the connecting member 104 has a plurality of end flaps 106 and side flaps 108 extending from the connecting member and being free of the main body 80, as well as the connecting member 102.

As shown in FIG. 5, the end flaps are one-piece, members integral with the member 104 and have connectors 110 defined thereof, such as snap-fasteners, which can be snapped to each other after the ends of flaps 106 have been wrapped around the associated tubular member or end member 22.

Likewise, the side flaps have substantially identical fasteners 110 and again are wrapped around the side tubes of the frame 14. The side flaps 108 are preferably formed into first and second portions **108*a* and 108*b*, that are identical in construction and each side flap 108*a* and 108*b* is divided into segments 109. The segments 109 of each flap 108 are dimensioned such that the enlarged portion of the flap is connected to one of the tubes 32 or 34, while the smaller portion of segments 109 is connected to one of the ends members, preferably spaced outwardly from the cross-brace 56**.

Thus, it will be appreciated from the above description, the inflatable mattress 12 can easily be connected to the rigid frame structure by wrapping the flaps 106 and 108 around the hollow tubes forming the periphery of the frame 14 and can be connected thereto utilizing the snap-fasteners 110. In the assembled and inflated condition, the support bed is generally as shown in FIG. 1, and provides a support-surface along the upper surface of the main body 80 for supporting a person and the legs 24 and 60 will support the unit above the floor while the cross-braces 28 and 56 will act as intermediate supports for the inflatable mattress 12. When the unit is to be collapsed for storage, the air from the inflatable mattress 12 is removed so that the mattress becomes a flat body of material and the frame is broken-down by releasing the latches 72 and slide locks 38 to allow the end members to be separated from tubes 32 and 34 and the tubes 32 and 34 pivoted vertical and parallel to the intermediate support portion 24. Likewise, the toggle links 64 are collapsed so that the end legs 60 extend parallel to the end members 22. In the collapsed position, the support bed is generally collapsed to the position shown in FIG. 7, wherein the overall height of the unit for storage is in the vicinity of $\frac{1}{4}$ of the height of the length of the bed, which it defines in the fully-extended position.

According to one aspect of the invention, the inflator 16 is preferably a power-operated unit that can be utilized for inflating the air mattress 12 and also deflating the mattress, if desired. As illustrated in FIGS. 8 and 9, the inflator 16 consists of a generally elongated circular housing 130 that has an electric motor (not shown) having a rotating pump element (not shown) supported therein with an outlet 132 at one end and an inlet 134 at the opposite end with a handle structure 136 for transporting the housing 130. A reversible end cap 140 having an outlet 142 is adapted to be connected to the outlet 132 or the inlet 134 of the housing 130 through a threaded coupling or other releasable connection (not shown).

Thus, the inflator 16 can be utilized as an inflating device by connecting the end cap 140 to the outlet end 132 leaving the inlet end 134 open so that connection of the electric motor through a cord to a power source (not shown) will allow the device to be utilized as a pump or inflator for the air mattress through the inlet connection 144 (FIG. 2). When the support bed is to be collapsed for storage, the position of the end cap 140 can be reversed and the inflator 16 will act as a vacuum pump deflating device by connection to the connection 142 of the main body 80.

As can be appreciated from the above description, the present invention provides an extremely simplified construction which can be manufactured at a minimum cost, can easily be assembled by the user without the use of any extraneous tools, can also be set-up and collapsed by one person without any special tools or mechanical skills, and can easily be stored in a very compact space. In fact, the single-type bed constructed in accordance with the teachings of the present invention can easily be placed into a backpack and can be transported by a camper because of the small, compact nature of the unit. Furthermore, the unit can easily be stored in a very small space that is normally wasted space in small units, such as apartments, condominiums, hotel rooms, etc. Such space could be in the nature of closet space along the rear wall thereof.

We claim:

1. A portable and collapsible bed comprising an elongated, generally rectangular tubular frame and an inflatable mattress, said inflatable mattress including a main hollow flexible body adapted to be inflated and having a peripheral configuration conforming generally to said tubular frame, an attaching member joined to said main body on one side thereof, said attaching member including flap-defining means providing a plurality of flaps which extend freely outwardly toward the periphery of said main body from permanent connection means spaced substantially inwardly of the periphery of said main body, said attaching member further including an intermediate layer of material underlying said main body and joined to said main body at the periphery thereof, said flap defining means comprising a further layer of material underlying said intermediate layer and joined to said intermediate layer inwardly of the periphery of said main body to provide said permanent connection means, and connector means on outer free ends of each of said flaps for releasable connection to portions of said tubular frame.

2. A portable and collapsible bed as defined in claim 1, in which said flexible main body is formed of a heat sealable material and said attaching member is formed of a compatible heat sealable material with said attaching member heat-sealed to said main body at the periphery of said main body.

3. A portable and collapsible bed as defined in claim 2, in which each of said flaps has a foldable portion at said outer end thereof and a connector on said foldable portion to provide said connector means.

4. A portable and collapsible bed as defined in claim 2, in which said flexible main body includes at least two layers of heat sealable material joined to each other and in which said attaching member is heat sealed to said main body only at said periphery thereof, said further layer of material being heat sealed to said intermediate layer of material inwardly of said periphery to provide said permanent connection means.

5. A portable and collapsible bed as defined in claim 4, in which said main body has a plurality of internal baffles joined to said two layers of said main body to define cells and a peripheral connecting piece extending between said two layers of said main body with upper and lower heat sealed joints between said peripheral connecting piece and said two layers of said main body, said intermediate layer of said attaching member being joined to said main body at said lower heat sealed joint.

6. A portable and collapsible bed as defined in claim 1, in which said tubular frame includes generally U-shaped rigid tubular end members defining opposite ends thereof and a support leg pivoted on each tubular end member between collapsed and supporting positions.

7. A portable and collapsible bed as defined in claim 6, in which said tubular frame includes an intermediate portion between said tubular ends members, said intermediate portion having a generally U-shaped center support leg having brackets on free ends thereof with first and second tubes pivotally mounted on each of said brackets with said end members releasably received on the free ends of respective ones of said first and second tubes.

8. A portable and collapsible bed as defined in claim 7, in which said flaps include first and second end flaps respectively joined to said tubular end members by said connector means on said flaps, and first and second side flaps joined to said tubes and said end members.

9. A portable and collapsible bed as defined in claim 1, further including an inflator connected to said tubular frame and having an outlet connectable to said inflatable mattress.

10. A portable and collapsible bed as defined in claim 9, in which said inflator includes a housing having an inlet and an outlet with a pump with said pump delivering pressurized fluid from said inlet to said outlet and an end cap connectable to said inlet and said outlet so that said pump can act as an inflating and a deflating device.

11. An inflatable mattress configured for releasable attachment to an associated generally rectangular frame having a pair of spaced tubular end frame members and transversely spaced tubular side frame portions extending between said end frame members, said inflatable mattress comprising:

a generally rectangular inflatable flexible main body including generally rectangular upper and lower heat sealable layers joined to each other by peripheral connecting means, said main body further including internal baffle means joined to said upper and lower main body layers for defining a plurality of cells within said main body; and means for detachably securing said mattress to said associated frame comprising an attaching member joined to said main body at the lower side thereof, said attaching member comprising flap-defining means for providing a plurality of flaps which each extend freely outwardly from connection means spaced substantially inwardly of the periphery of said main body, each said flap extending toward the periphery of said main body, and each said flap including releasable connector means for releasably connecting each flap to said associated tubular frame to thereby secure said inflatable mattress to said frame, said flaps including a pair of opposite end flaps configured for releasable connection to a respective one of said end frame members of said tubular frame, said flaps further including at least one side flap at each transverse side of said inflatable mattress for releasable connection to a respective one of said side frame portions, said attaching member further comprising an intermediate layer of material underlying said lower layer and joined to said main body by means spaced from said connection means, said flap-defining means comprising a further layer of material generally underlying said intermediate layer and joined to said intermediate layer by said connection means so that said flap extend freely outwardly beneath said intermediate layer.

12. An inflatable mattress as defined in claim 11, wherein said intermediate layer comprises heat sealable material underlying said lower layer and is joined to said main body of said mattress outwardly of said conneciton means.

13. An inflatable mattress as defined in claim 12, wherein said peripheral connecting means of said main body comprises a peripheral connecting piece extending between and connected to said upper and lower main body layers at respective upper and lower heat seal joints, said intermediate layer of said attaching member being joined to said main body at said lower heat seal joint.

14. A portable and collapsible bed, comprising:

a generally rectangular tubular frame including a pair of longitudinally opposite end frame members and a pair of laterally opposite side frame portions configured to extend between said end frame members, and an inflatable mattress configured for releasable attachment to said tubular frame, said mattress comprising a generally rectangular, inflatable flexible main body including generally rectangular upper and lower heat sealable layers joined to each other by a peripheral connecting piece extending between and connected to said upper and lower main body layers by respective upper and lower heat seal joints, said main body further including a plurality of internal baffles extending between and connected to said upper and lower main body layers for defining a plurality of cells within said main body, said inflatable mattress further including an attaching member for detachably connecting said mattress to said tubular frame, said attaching member including an intermediate heat sealable layer underlying said lower main body layer, the peripheral edge portion of said intermediate layer being joined to said main body at said lower heat seal joint while the remainder of said intermediate layer is detached from said main body, said attaching member further including a flap-defining layer generally underlying said intermediate layer, said flap-defining layer being joined to said intermediate layer at heat sealed connection means spaced substantially inwardly of the periphery of said main body to provide a plurality of flaps which extend freely outwardly from said heat sealed connection means, each of said flaps including connector means for releasably connecting the flap to itself so that the flaps can be folded about the end members and side portions of said tubular frame and connected with said connector means to thereby secure said inflatable mattress to said tubular frame.

15. An inflatable mattress configured for releasable attachment to an associated generally rectangular frame, said inflatable mattress comprising:

a generally rectangular inflatable flexible main body including generally rectangular upper and lower layers joined to each other by peripheral connecting means; and means for detachably securing said mattress to said associated frame comprising an attaching member joined to said main body and comprising a flap-defining member for providing a plurality of flaps which extend freely outwardly from connection means spaced substantially inwardly of the periphery of said main body, each said flap including releasable connector means for releasably connecting each said flap to said associated frame, said attaching member further comprising an intermediate layer of material underlying said lower layer of said main body, said flap-defining member being positioned beneath said intermediate layer and being joined to said intermediate layer by said connection means, said intermediate layer being joined to said main body by joining means spaced from said connection means between said intermediate layer and said flap-defining member.

16. An inflatable mattress in accordance with claim 15, wherein said connection means comprises a heat-seal joint between said intermediate layer and said flap-defining member, and said joining means is spaced outwardly of said connection means.

17. An inflatable mattress in accordance with claim 15, wherein said connection means comprises a heat-seal joint between said intermediate layer and said flap-defining means, and said joining means is spaced outwardly of said connection means and joins said attaching member to said main body at said peripheral connecting means.

18. An inflatable mattress configured for releasable attachment to an associated generally rectangular frame, said inflatable mattress comprising:

a generally rectangular inflatable flexible main body including generally rectangular upper and lower layers joined to each other by peripheral connecting means; and means for detachably securing said mattress to said associated frame comprising an attaching member joined to said main body and comprising a generally rectangular intermediate layer substantially the same size as said lower layer and underlying said lower layer, said intermediate layer being joined to said main body at said peripheral connecting means of said main body, said attaching member further including means providing a plurality of flaps each having releasable connector means whereby each said flap can be releasably secured to said associated rectangular frame, said flap-providing means being joined to said intermediate layer of said attaching member by permanent connection means comprising a heat seal joint between said intermediate layer and said flap-providing means.

19. An inflatable mattress in accordance with claim 18, wherein said flap-providing means comprises a flap-defining member underlying said intermediate layer, and said permanent connection means comprises a heat-seal joint between said intermediate layer and said flap-defining member positioned inwardly of said peripheral connecting means of said main body.

* * * * *